US005511952A

United States Patent [19]

Sato

[11] Patent Number: 5,511,952

[45] Date of Patent: Apr. 30, 1996

[54] REFRIGERANT DISPLACEMENT APPARATUS WITH AN IMPROVED THERMAL SENSING DEVICE

[75] Inventor: Tadashi Sato, Maebashi, Japan

[73] Assignee: Sanden Corporation, Isesaki, Japan

[21] Appl. No.: 246,517

[22] Filed: May 20, 1994

[51] Int. Cl.[6] ..... F04B 21/00; F01C 1/04

[52] U.S. Cl. ..... 417/63; 418/2; 418/55.1

[58] Field of Search ..... 418/2, 55.1; 417/63

[56] References Cited

U.S. PATENT DOCUMENTS 4,597,724 7/1986 Sato et al. ..... 418/55.1
5,368,446 11/1994 Rode ..... 417/17

FOREIGN PATENT DOCUMENTS 4318298 11/1992 Japan ..... 418/55.1
5195968 8/1993 Japan ..... 418/55.1

*Primary Examiner*—Charles Freay
*Attorney, Agent, or Firm*—Baker & Botts

[57] ABSTRACT

A scroll type fluid displacement apparatus includes a housing in which interfitting fixed and orbiting scrolls are disposed. The outer surface of the end plate of the fixed scroll and the inner surface of the housing are in fluid tight contact so that the interior of the housing is partitioned into two chambers. After the refrigerant is compressed, it is discharged through a discharge bore into the second chamber. A dividing wall formed in the second chamber partially surrounds the discharge bore. The compressor housing has a recessed portion near the outlet port. A thermal sensor is positioned in the recessed portion. A passageway formed in the dividing wall directs the air flowing out of the discharge bore against the inside surface of the housing where the thermal sensor is positioned.

10 Claims, 5 Drawing Sheets

REFRIGERANT DISPLACEMENT APPARATUS WITH AN IMPROVED THERMAL SENSING DEVICE

BACKGROUND OF THE INVENTION

1. Field of the Invention

This invention relates to a fluid displacement apparatus, and more particularly, to an improvement in a thermal sensing device in a fluid displacement apparatus.

2. Description of the Prior Art

A scroll type fluid displacement apparatus is well known in the prior art. For example, U.S. Pat. No. 4,411,604 issued to Terauchi discloses a basic construction of a scroll type fluid displacement apparatus.

Generally, in the conventional refrigerant compressor, when the temperature of the refrigerant gas excessively rises, the compressor is not operating normally and increased frictional resistance between the moving parts of the compressor results. It is particularly problematic when the temperature of the refrigerant gas at the center of a scroll excessively rises, since conduction, convection and radiation cooling of the central compressor components to the atmospheric air is substantially small. One proposed solution for preventing compressor overheating employs a sensing device which terminates compression, i.e., disengages the electromagnetic clutch, when the temperature of the refrigerant gas rises above a predetermined temperature.

Referring to FIG. 1 and 2, a scroll type fluid displacement apparatus in accordance with the prior art is shown. Compressor unit 1 includes housing 10 having front end plate 11 mounted on cup-shaped casing 12. Opening 111 is formed in the center of front end plate 11 for penetration or passage of drive shaft 13. Annular projection 112 is formed in a rear end surface of front end plate 11. Annular projection 112 faces cup-shaped casing 12 and is concentric with opening 111. An outer peripheral surface of annular projection 112 extends into an inner wall of the opening of cup-shaped casing 12 so that the opening of cup-shaped casing 12 is covered by front end plate 11. O-ring 14 is placed between the outer peripheral surface of annular projection 112 and the inner wall of the opening of cup-shaped casing 12 to seal the mating surfaces therebetween.

Annular sleeve 15 is fixed to and projects from the front end surface of front end plate 11 to surround drive shaft 13 and define a shaft seal cavity. Drive shaft 13 is rotatably supported by sleeve 15 through bearing 18 located within the front end of sleeve 15. Drive shaft 13 has disk 19, at inner end thereof, which is rotatably supported by front end plate 11 through beating 20 located within opening 111 of from end plate 11. Shaft seal assembly 21 is coupled to drive shaft 13 within the shaft seal cavity of sleeve 15.

Pulley 22 is rotatably supported by bearing 23 which is carded on the outer surface of sleeve 15. Electromagnetic coil 24 is fixed about the outer surface of sleeve 15 by supporting plate 25 and is received in the annular cavity of pulley 22. Armature plate 26 is elastically supported on the outer end of drive shaft 13 which extends beyond sleeve 15. Pulley 22, magnetic coil 24 and armature plate 26 form a magnetic clutch. In operation, drive shaft 13 is driven by an external power source, for example the engine of an automobile, through a rotation transmitting device such as the above-explained magnetic clutch.

A number of elements are located within cup-shaped casing 12, including fixed scroll 27, orbiting scroll 28, and rotation preventing/thrust bearing device 35 for orbiting scroll 28. The compression chamber is defined by the inner wall of cup-shaped casing 12 and the rear end surface of front end plate 11.

Fixed scroll 27 includes circular end plate 271, wrap or spiral element 272 affixed to or extending from one end surface of end plate 271 and an internally threaded boss 273 axially projecting from the other end surface of end plate 271. Internally threaded boss 273 includes first rib portion **273*a* and second rib portion 273*b* radially facing each other and surrounding discharge port 274. Further, internally threaded boss 273 includes first notch portion 273*c* and second notch portion 273*d* radially facing each other and surrounding discharge port 274. An axial end surface of rib portions 273*a* and 273*b* are sealed on the inner end surface of bottom plate portion 121. Rib portions 273*a* and 273*b* are provided with tapped holes 254 for receiving bolts 37. Tapped holes 254 are reinforced by the wall portion therebetween. Fixed scroll 27 is secured to bottom plate 121 by bolts 37 which screw into tapped holes 254. In this manner, fixed scroll 27 is secured within the inner chamber of cup-shaped casing 12**.

Circular end plate 271 of fixed scroll 27 partitions cup-shaped casing 12 into front chamber 29 and rear chamber 30. Seal ring 31 is disposed within a circumferential groove on circular end plate 271 to form a seal between the inner wall of cup-shaped casing 12 and the outer surface of circular end plate 271. Spiral element 272 of fixed scroll 27 is located within front chamber 29.

Cup-shaped casing 12 has a fluid inlet port 36 and a fluid outlet port 39, which are connected to rear and front chambers 29 and 30, respectively. Further, cup-shaped casing 12 is provided with sensor pocket 122 in which thermal sensor 60 is disposed. Thermal sensor 60 terminates compression when the temperature of the refrigerant gas exceeds a predetermined value. The compressed refrigerant gas strikes against thermal sensitive area 123 formed on inner surface of cup-shaped casing 12 corresponding to the bottom of sensor pocket 122. A hole or discharge port 274 is formed through circular end plate 271 at a position near the center of spiral element 272. Retainer 50 and read valve 38 are fixedly secured to circular end plate 271 by bolt 51. Reed valve 38 closes discharge port 274 when the pressure in discharge chamber 30 exceeds the pressure in the central fluid pocket.

Orbiting scroll 28, which is located in front chamber 29, includes circular end plate 281 and wrap or spiral element 282 affixed to or extending from one end surface of circular end plate 281. Spiral elements 272 and 282 interfit at an angular offset of 180° and at a predetermined radial offset. Spiral elements 272 and 282 define at least one pair of sealed off fluid pockets between theft interfitting surfaces. Orbiting scroll 28 is rotatably supported by bushing 33 through beating 34 placed between the outer peripheral surface of bushing 33 and the inner surface of annular boss 288, which axially projects from the end surface of circular end plate 281. Bushing 33 is connected to an inner end of disk 19 at a point radially offset or eccentric to the axis of drive shaft 13.

Rotation preventing/thrust bearing device 35 is disposed around the outer peripheral surface of boss 288 and placed between the inner end surface of front end plate 11 and the end surface of circular end plate 281. Rotation preventing/thrust bearing device 35 includes fixed ring 351 attached to the inner end surface of front end plate 11, orbiting ring 352 attached to the end surface of circular end plate 281, and a plurality of bearing elements, such as balls 353, placed between the pocket formed by tings 351 and 352. Rotation of orbiting scroll 28 during orbital motion is prevented by the interaction of balls 353 with tings 351, 352. The axial thrust load from orbiting scroll 28 also is supported on front end plate 11 through balls 353.

With reference to FIG. 2, the compressed refrigerant gas exhausted from discharge port 274 flows radially, outwardly and branches into two flows paths. One flow path is through first notch portion 273*c* and a second flow path is through second notch portion 273*d* as shown by the arrows in FIG. 2. The separate flow paths flow along the inside surface of cup-shaped casing 12 and merge at fluid outlet port 39. From there, the compressed refrigerant gas is delivered to other components in the air conditioning circuit, e.g., a condenser.

The temperature of the compressed refrigerant gas is measured by thermal sensor 60 disposed in sensor pocket 122. Thermal sensor 60, however, only senses the temperature of the refrigerant in one of the two flow paths, that which flows through second notch portion 273*d*. The refrigerant flowing through the second flow path (through first notch portion 273*c*) essentially avoids contact with thermal sensitive area 123. Consequently, there is a difference between the actual temperature of the compressed gas and the temperature sensed by thermal sensor 60. As a result, it is considerably difficult in this arrangement to approximate the actual temperature of the compressed gas.

SUMMARY 0F THE INVENTION

It is an object of the preferred embodiments to provide a fluid displacement apparatus with a improved thermal sensing device which accurately senses the temperature of the compressed fluid.

It is another object of the preferred embodiments to provide a fluid displacement apparatus wherein the durability of the inner parts is improved.

A fluid displacement apparatus according to the preferred embodiments includes a housing comprising a cup-shaped casing and an end plate coveting the opening to the cup-shaped casing. The end plate has an annular extension within which a drive shaft is rotatably supported.

A fixed scroll is fixedly secured to the cup-shaped casing. The fixed scroll includes a circular end plate and a spiral wrap extending from one end of the circular end plate. The circular end plate partitions the interior of the housing into first and second chambers. A fluid inlet port is associated with the first chamber and a fluid outlet port is associated with the second chamber. A discharge bore at the center of the circular end plate of the fixed scroll provides fluid communication between the first and second chambers.

An orbiting scroll is positioned within the first chamber. The orbiting scroll includes a circular end plate and a spiral wrap extending from the circular end plate. The spiral wrap of the fixed scroll and the spiral wrap of the orbiting scroll interfit at an angular and radial offset to define at least one pair of sealed off fluid pockets. The drive shaft is operatively coupled to the orbiting scroll. A rotation prevention mechanism positioned between the circular end plate and the end plate of the compressor housing permit the orbiting scroll, in response to the rotation of the drive shaft, to follow an orbital path. Consequently, the fluid in the first chamber taken into the fluid pockets is compressed as it is moved toward the center of the spiral elements. From there, the fluid is discharged through the discharge bore into the second chamber.

A dividing wall is provided on the circular end plate in the second chamber. The dividing wall surrounds the discharge bore and has a flow passage formed therein. The compressor housing is formed with a recessed portion adjacent the outlet port. The bottom of the recessed portion comprises a thermal sensitive area whose temperature is indicative of the temperature of the fluid exiting the discharge bore. A thermal sensor is situated in the recessed portion. The flow passage in the dividing wall directs the fluid exiting the discharge bore against the thermal sensitive area. In this manner, an accurate representative sampling of the fluid temperature in the second chamber may be obtained from the thermal sensor.

Further objects, features and other aspects of this invention will be understood from the following detailed description of the preferred embodiments while referring to the annexed drawings.

DETAILED DESCRIPTION OF THE PREFERRED EMBODIMENTS

Figure 1:
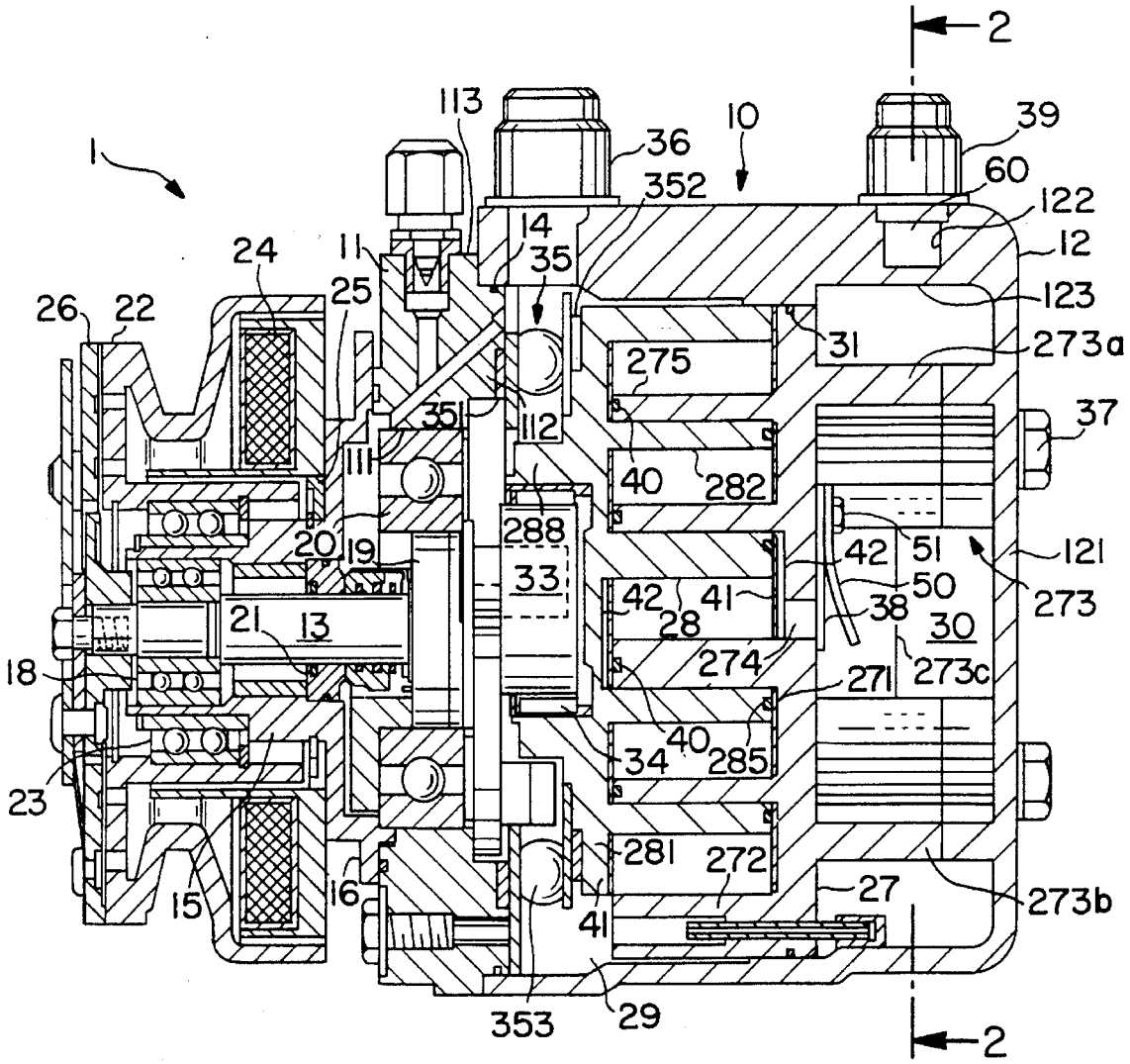
FIG. 1 (PRIOR ART)
FIG. 1 is a cross sectional view of a scroll type fluid displacement apparatus in accordance with the prior art.
Figure 2:
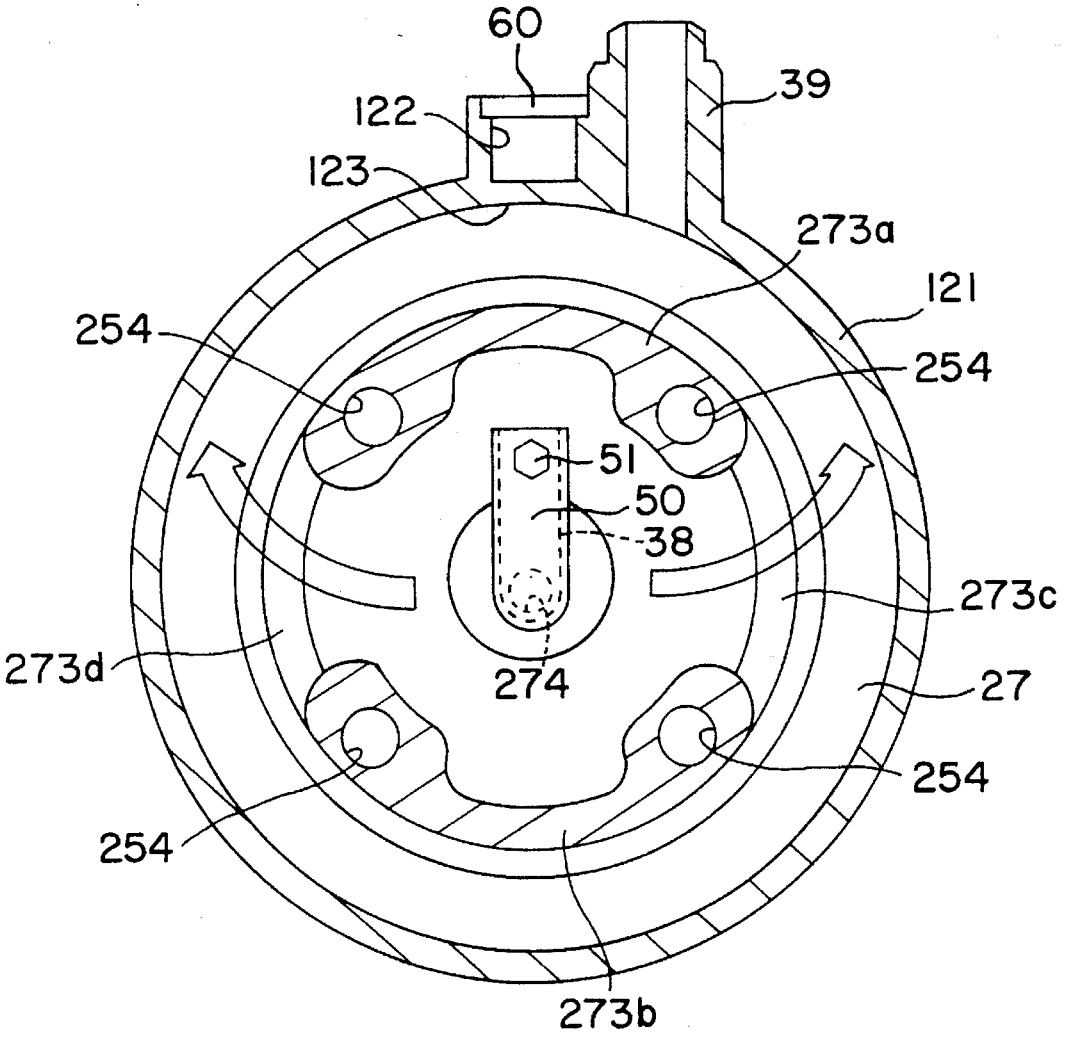
FIG. 2 (PRIOR ART)
FIG. 2 is a cross sectional view taken along line 2—2 of FIG. 1.

For convenience of description, the same numerals are used in FIGS. 3–8 to denote the corresponding elements shown FIG. 1 and 2, and detailed explanations of those elements are omitted.

Figure 3:
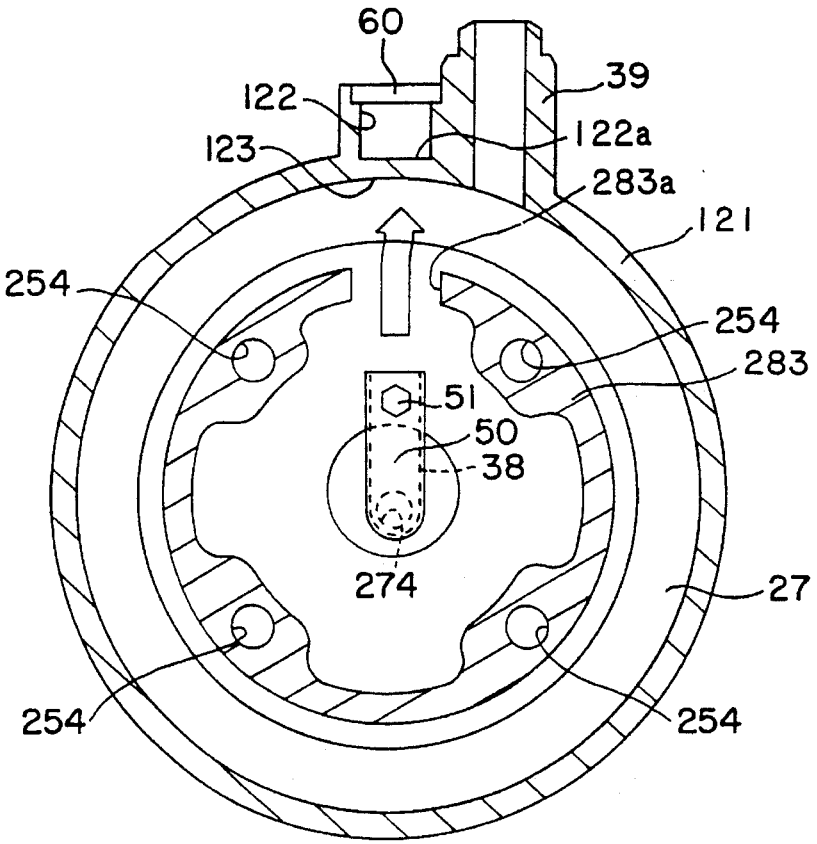
FIG. 3 is a cross sectional view similar to FIG. 2, but accordance with a first preferred embodiment.
Figure 4:
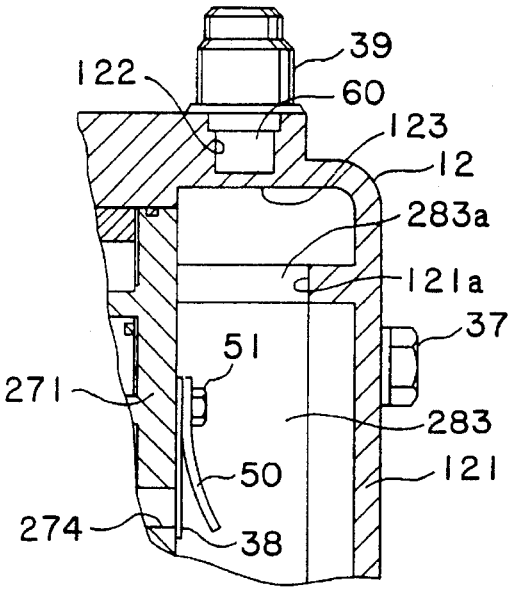
FIG. 4 is an enlarged detail illustrating the thermal sensing device according to the first preferred embodiment.

FIGS. 3 and 4 illustrate a first preferred embodiment. Cup-shaped casing 12 includes sensor pocket 122 in which thermal protector 60 is disposed. Sensor pocket 122 of cup-shaped casing 12 is hollow and extends from the outer surface of cup-shaped casing 12 in a radially central direction of the compressor. Sensor pocket 122 is preferably positioned adjacent fluid outlet port 39. The thickness between bottom surface 122*a* of sensor pocket 122 and thermal sensitive area 123 is preferably about 3–6 mm. Fixed scroll 27 includes internally threaded boss 283 axially projecting from end plate 271 and surrounding discharge port 274. An axial end surface 121*a* of internally threaded boss 283 is sealed on inner surface 121*a* of bottom plate portion 121. Furthermore, internally threaded boss 283 includes notch portion 283*a* formed between tapped holes 254. Notched portion 283*a* radially faces thermal sensitive area 123 of bottom plate portion 121. The radial width of notch portion 283*a* is nearly the same as that of bottom surface 122*a* of sensor pocket 122.

In this arrangement, the compressed gas exhausted from discharge port 274 flows through notch portion 283*a* and impinges upon thermal sensitive area 123 of bottom plate portion 121 as indicated by the arrow in FIG. 3. Most of the compressed gas strikes against thermal sensitive area 123 before flowing through fluid outlet port 39. By directing the compressed gas against thermal sensitive area 123, thermal portion 60 can accurately sense an approximate value of the actual temperature of the compressed gas. Further, the operation of the compressor can be reliably terminated when the temperature of the compressed gas at the center of scroll excessively rises. As a result, durability of the compressor is improved.

Figure 5:
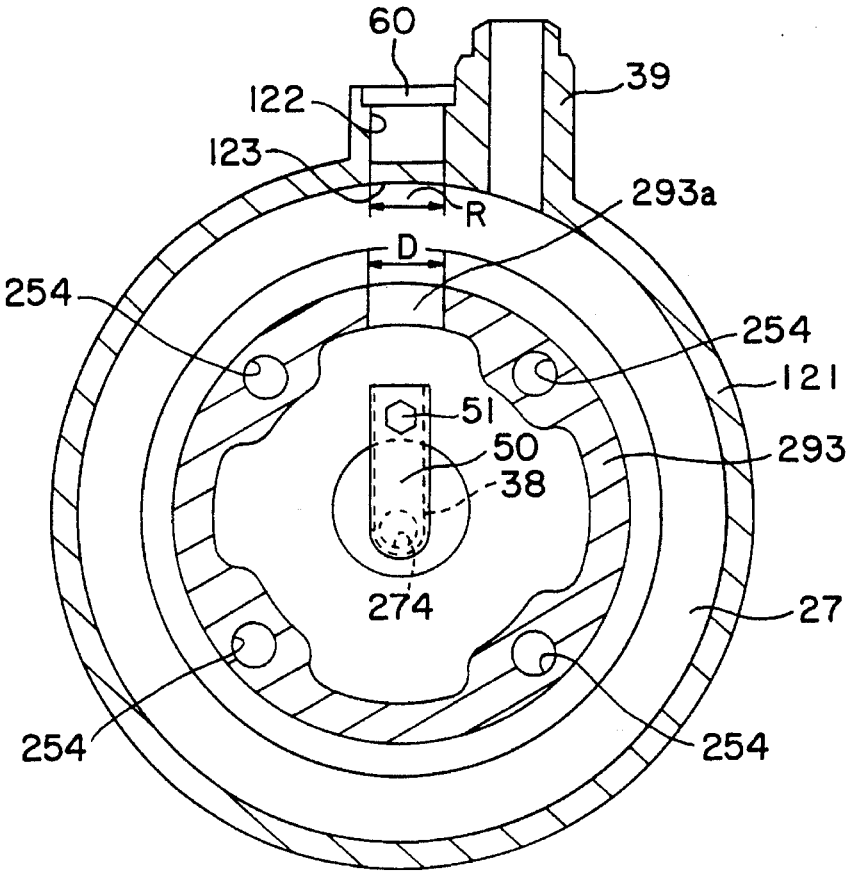
FIG. 5 is a cross sectional view similar to FIG. 2, but FIG. 1 in accordance with a second preferred embodiment.
Figure 6:
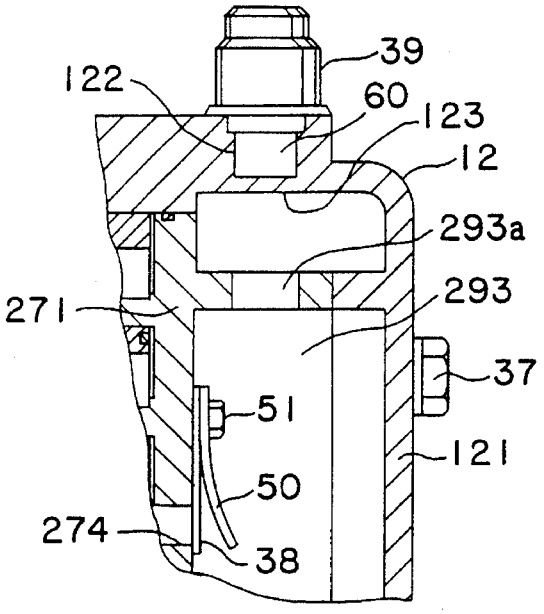
FIG. 6 is an enlarged detail illustrating the thermal sensing device according to the second preferred embodiment.

FIG. 5 and 6 illustrate a second preferred embodiment. Internally threaded boss 293 includes opening 293*a* formed between tapped holes 254 and radially facing thermal sensitive area 123. Opening 293*a* is shaped as a cylindrical hole having diameter D which is almost the same size as diameter R of the bottom surface of sensor pocket 122. Opening 293*a* is radially aligned with sensor pocket 122 so that nearly all of the compressed gas flowing through opening 293*a* impinges upon thermal sensitive area 123.

Figure 7:
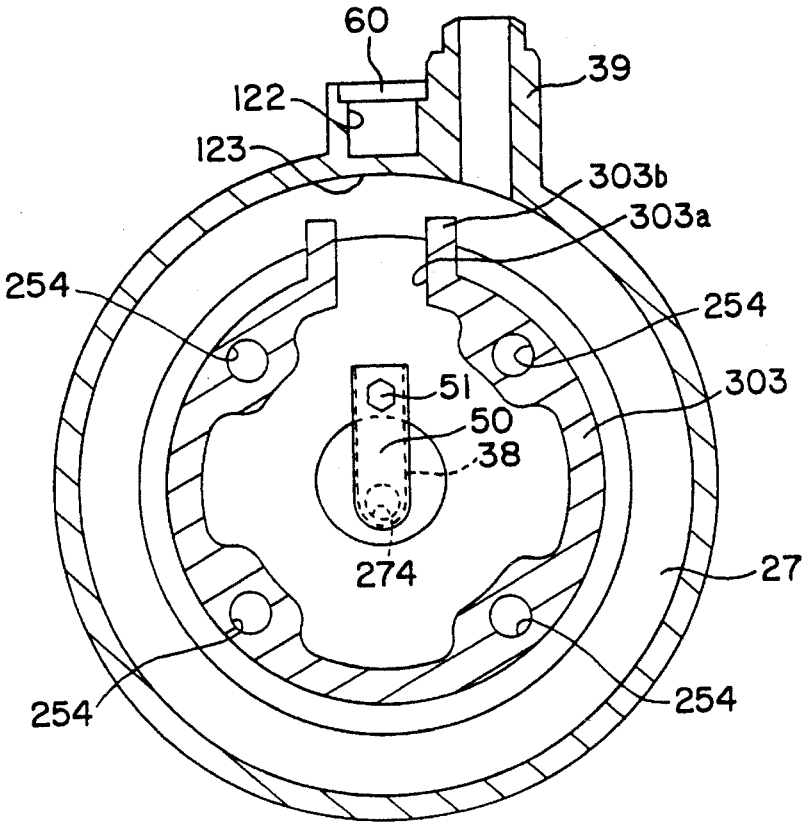
FIG. 7 is a cross sectional view similar to FIG. 2, but in accordance with a third preferred embodiment.
Figure 8:
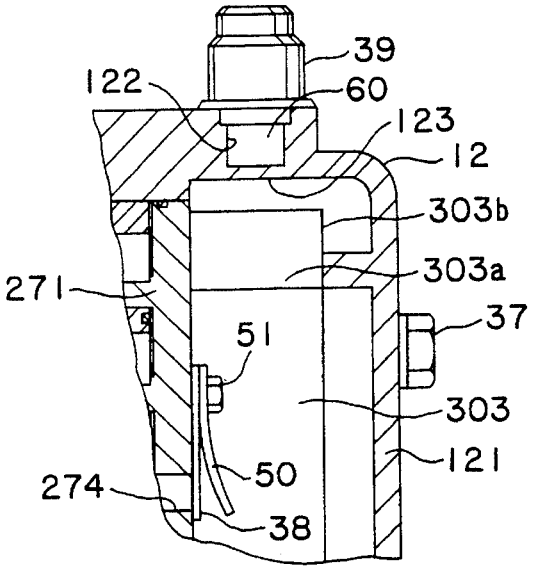
FIG. 8 is an enlarged detail illustrating the thermal sensing device according to the third preferred embodiment.

FIG. 7 and 8 illustrate a third preferred embodiment. Internally threaded boss 303 includes passage 303*a* formed between tapped holes 254 and radially facing thermal sensitive area 123 of bottom plate portion 121. Internally threaded boss 303 includes projection portion 303*b* extending from opening 303*a* in the direction of thermal sensitive area 123. Projection portion 303*b* guides the compressed gas against thermal sensitive area 123 to assure that a maximum representative sampling of compressed gas is sensed by thermal sensitive area 123.

The functions and effects of these further embodiments are similar to the function and the effects of the first preferred embodiment, so an explanation thereof is omitted.

This invention has been described in connection with the preferred embodiments. These embodiments, however, are merely exemplary only and the invention is not restricted thereto. It will be easily understood by those skilled in the art that variations can be easily made within the scope of this invention as defined by the appended claims.

I claim:

1. A fluid displacement apparatus comprising:

a housing;

a first chamber formed in said housing and in fluid communication with a fluid inlet port;

a second chamber formed in said housing and in fluid communication with a fluid outlet port;

a discharge port for providing fluid communication between said first and second chambers;

a recessed portion formed adjacent said fluid outlet port, said recessed portion having a thermal sensitive area corresponding to a bottom surface of the recess;

a thermal sensor positioned in said recessed portion;

a partition wall formed in said second chamber for partitioning said second chamber into two sections, said partition wall at least partially surrounding said discharge port; and means, associated with said partition wall, for aiming substantially all of the fluid discharged through said discharge port directly against said thermal sensitive area.

2. The fluid displacement apparatus of claim 1, said directing means comprising a passage formed through said partition wall.

3. A fluid displacement apparatus comprising:

a housing;

a first chamber formed in said housing and in fluid communication with a fluid inlet port;

a second chamber formed in said housing and in fluid communication with a fluid outlet port;

a discharge port for providing fluid communication between said first and second chambers;

a recessed portion formed adjacent said fluid outlet port, said recessed portion having a thermal sensitive area corresponding to a bottom surface of the recess;

a thermal sensor positioned in said recessed a partition wall formed in said second chamber for positioning said second chamber into two sections, said partition wall at least partially surrounding said discharge port; and means, associated with said partition wall, for directing the fluid discharged through said discharge port against said thermal sensitive area, said directing means comprising a passage formed through said partition wall, wherein said passage and said thermal sensitive area having substantially the same cross sectional area.

4. A fluid displacement apparatus comprising:

a housing;

a first chamber formed in said housing and in fluid communication with a fluid inlet port;

a second chamber formed in said housing and in fluid communication with a fluid outlet port;

a discharge port for providing fluid communication between said first and second chambers;

a recessed portion formed adjacent said fluid outlet port, said recessed portion having a thermal sensitive area corresponding to a bottom surface of the recess;

a thermal sensor positioned in said recessed portion;

a partition wall formed in said second chamber for partitioning said second chamber into two sections, said partition wall at least partially surrounding said discharge port;

means, associated with said partition wall, for directing the fluid discharged through said discharge port against said thermal sensitive area, said directing means comprising a passage formed through said partition wall, and projections extending from said partition wall, said projections facilitating the flow of fluid against said thermal sensitive area.

5. A scroll type fluid displacement apparatus comprising:

a housing having a fluid inlet port and a fluid outlet port;

a driving mechanism including a drive shaft rotatably supported by said housing and a drive pin eccentrically extending from an inner end of said drive shaft;

a fixed scroll member fixedly disposed relative to said housing and having a first end plate from which a first wrap extends;

an orbiting scroll, operatively coupled to said driving mechanism, having a second end plate from which a second wrap extends, said first and second wraps interfitting at an angular and radial offset to form a plurality of line contacts to define at least one pair of sealed off fluid pockets;

a discharge chamber provided in said housing adjacent said fixed scroll member on the side of said first end plate opposite the side from which said first wrap extends, said first end plate having a discharge bore communicating between a central fluid pocket and said discharge chamber;

a recessed portion formed in said housing adjacent said fluid outlet port;

a thermal sensor device positioned in said recessed portion, said thermal sensor device sensing the temperature of a thermal sensitive area against which the fluid in said discharge chamber strikes;

a dividing wall disposed in said discharge chamber and at least partially surrounding said discharge bore; and means associated with said dividing wall for aiming substantially all of the fluid discharged through said discharge bore directly against said thermal sensitive area.

6. The scroll type compressor of claim 5, said dividing wall further having tapped holes formed therein, said tapped holes receiving bolts for fixedly securing said fixed scroll to said housing.

7. The scroll type compressor of claim 5, said directing means comprising a passage formed through said dividing wall.

8. A scroll type fluid displacement apparatus comprising:

a housing having a fluid inlet port and a fluid outlet port;

a driving mechanism including a drive shaft rotatably supported by said housing and a drive pin eccentrically extending from an inner end of said drive shaft;

a fixed scroll member fixedly disposed relative to said housing and having a first end plate from which a first wrap extends;

an orbiting scroll, operatively coupled to said driving mechanism, having a second end plate from which a second wrap extends, said first and second wraps interfitting at an angular and radial offset to form a plurality of line contacts to define at least one pair of sealed off fluid pockets;

a discharge chamber provided in said housing adjacent said fixed scroll member on the side of said first end plate opposite the side from which said wrap extends, said first end plate having a discharge bore communicating between a central fluid pocket and said discharge chamber;

a recessed portion formed in said housing adjacent said fluid outlet port;

a thermal sensor device positioned in said recessed portion, said thermal sensor device sensing the temperature of a thermal sensitive area against which the fluid in said discharge chamber strikes;

a dividing wall disposed in said discharge chamber and at least partially surrounding said discharge bore; and means associated with said dividing wall for directing the fluid discharge through said discharge bore against said thermal sensitive area; wherein said dividing wall extending substantially entirely around said discharge bore, said directing means comprising a cylindrical hole formed through said dividing wall, said cylindrical hole radially aligned with said thermal sensitive area so that substantially all of the fluid passing through said cylindrical hole is directed against said thermal sensitive area.

9. The scroll type compressor of claim 8, said passage and said thermal sensitive area having substantially the same cross sectional area.

10. A scroll type fluid displacement apparatus comprising:

a housing having a fluid inlet port and a fluid outlet port;

a driving mechanism including a drive shaft rotatably supported by said housing and a drive pin eccentrically extending from an inner end of said drive shaft;

a fixed scroll member fixedly disposed relative to said housing and having a first end plate from which a first wrap extends;

an orbiting scroll, operatively coupled to said driving mechanism, having a second end plate from which a second wrap extends, said first and second wraps interfitting at an angular and radial offset to form a plurality of line contacts to define at least one pair of sealed off fluid pockets;

a discharge chamber provided in said housing adjacent said fixed scroll member on the side of said first end plate opposite the side from which said first wrap extends, said first end plate having a discharge bore communicating between a central fluid pocket and said discharge chamber;

a recessed portion formed in said housing adjacent said fluid outlet port;

a thermal sensor device positioned in said recessed portion, said thermal sensor device sensing the temperature of a thermal sensitive area against which the fluid in said discharge chamber strikes;

a dividing wall disposed in said discharge chamber and at least partially surrounding said discharge bore;

means associated with said dividing wall for directing the fluid discharged through said discharge bore against said thermal sensitive area; and projections extending from said partition wall, said projections facilitating the flow of fluid against said thermal sensitive area.

* * * * *